US007032757B2

(12) United States Patent
Richards et al.

(10) Patent No.: US 7,032,757 B2
(45) Date of Patent: Apr. 25, 2006

(54) TAMPER EVIDENT FOOD PACKAGING

(75) Inventors: Bill R. Richards, Pluckemin, NJ (US); Neil A. Willcocks, Fullerton, CA (US); Catherine Pitko, Boonton, NJ (US)

(73) Assignee: Mars, Incorporated, VA (US)

( * ) Notice: Subject to any disclaimer, the term of this patent is extended or adjusted under 35 U.S.C. 154(b) by 197 days.

(21) Appl. No.: 10/636,647

(22) Filed: Aug. 8, 2003

(65) Prior Publication Data

US 2004/0115316 A1 Jun. 17, 2004

Related U.S. Application Data

(60) Provisional application No. 60/402,420, filed on Aug. 8, 2002.

(51) Int. Cl.
*B65D 75/00* (2006.01)
*A22C 13/00* (2006.01)

(52) U.S. Cl. ..... 206/525.1; 206/807; 229/87.08; 229/102; 426/87; 426/106

(58) Field of Classification Search ..... 206/525.1, 206/807; 229/81, 102, 87.08, 87, 87.01; 426/106, 122, 124
See application file for complete search history.

(56) References Cited

U.S. PATENT DOCUMENTS

| | | | | |
|---|---|---|---|---|
| 1,198,288 | A | 9/1916 | Taylor | |
| 2,083,158 | A | 6/1937 | Ramsey | |
| 4,093,074 | A | 6/1978 | Bielawski | |
| 4,508,226 | A * | 4/1985 | Davis et al. | 206/807 |
| 4,566,627 | A | 1/1986 | Gendron | |
| 4,573,634 | A * | 3/1986 | Kohler et al. | 206/807 |
| 4,666,079 | A | 5/1987 | Bolli et al. | |
| 4,723,701 | A | 2/1988 | Deutschländer | |
| 4,724,997 | A | 2/1988 | Hogenkamp et al. | |
| 4,746,052 | A * | 5/1988 | Schmissrauter | 206/807 |
| 4,754,914 | A * | 7/1988 | Wischusen, III | 229/87.08 |
| 4,770,338 | A * | 9/1988 | Tatusch | 206/807 |
| 4,850,526 | A | 7/1989 | Naef et al. | |
| 4,874,096 | A | 10/1989 | Tessera-Chiesa | |
| 4,911,302 | A | 3/1990 | Butler | |
| 5,042,653 | A | 8/1991 | Ems | |
| 5,148,970 | A * | 9/1992 | Johnston | 229/102 |
| 5,207,374 | A * | 5/1993 | Lo Duca | 229/102 |
| 5,224,779 | A | 7/1993 | Thompson et al. | |
| 5,265,794 | A * | 11/1993 | Johnston | 229/102 |
| 5,366,087 | A | 11/1994 | Bane | |
| 5,671,882 | A | 9/1997 | Cerwinski et al. | |
| 5,987,850 | A | 11/1999 | Schoch et al. | |
| 6,070,790 | A * | 6/2000 | Anderson | 229/102 |
| 6,138,905 | A | 10/2000 | Hachenski | |
| 6,349,828 | B1 | 2/2002 | Sessions et al. | |

FOREIGN PATENT DOCUMENTS

| | | |
|---|---|---|
| DE | 1 030 247 | 5/1958 |
| EP | 0 718 209 | 6/1996 |

* cited by examiner

*Primary Examiner*—Luan K. Bui
(74) *Attorney, Agent, or Firm*—Fitzpatrick, Cella, Harper & Scinto

(57) ABSTRACT

Die fold and sleeve packaging uses a closed shape break-away portion located in a first region of a die fold wrapper adhesively attached to an overlapping region, such that when the packaging is tampered with, the closed shape breaks away from the first region, providing evidence of tampering and an optional communication feature.

11 Claims, 2 Drawing Sheets

TAMPER EVIDENT FOOD PACKAGING

This application claims the benefit of priority of U.S. Provisional Application No. 60/402,420, filed Aug. 8, 2002, and incorporated herein by reference.

BACKGROUND OF THE INVENTION

1. Field of the Invention

The invention is directed to packaging that will provide evidence of tampering to a die fold and sleeve primary package typically associated with chocolate bar products.

2. Description of the Related Art

Various seals and indicia, rupturable upon opening a package, are known in the art.

U.S. Pat. No. 4,874,096 is directed to a sealed packet for confectionery and the like with a reclosable adhesive opening strip. A supplementary strip may be applied to the opening strip, adhesively attached to the packaging and to the opening strip with a different level of adhesiveness, and also provided with pre-cut transverse lines, such that the strip breaks upon opening, which provides evidence of tampering if the opening strip is then reclosed.

U.S. Pat. No. 5,987,850 discloses a process for applying a revenue seal to a cigarette pack, for example. The seal is applied directly to the packaging, applying a laser beam to a smooth coating in the area where the seal is to be applied so that the seal will adhere better to that area. The seal is applied across a dividing line where the package is opened such that the seal will rupture on opening the cigarette pack.

U.S. Pat. No. 6,349,828 B1 is directed to a tamper evident packaging for a wound dressing in which two packaging layers are sealed to each other at their perimeter for example by heat sealing, adhesive sealing, RF sealing, or ultrasonic sealing. The layers may be sheets of medical grade paper, plastic, foil or the like. Within the sealing region on the perimeter are provided perforations in one or both packaging layers such that when the package is opened the layer tears along the perforation, leaving a portion of the layers attached and thus providing evidence that the package has been fully or partly opened.

It is also known to provide a confectionery product with a completely sealed inner wrapper of foil or foil-like material. However, once such a package is opened, it is completely and unattractively torn. The inner wrapper cannot subsequently function as a "plate" for the product, nor can it be neatly and conveniently re-wrapped around the product. Such a package may provide evidence of tampering, but important functionality of the wrapper is lost.

Confectionery products are handled by a large number of people at the point of sale prior to being finally purchased and consumed. This raises a particular concern that these products are more likely to be subjected to tampering. Thus, it is particularly desirable and an object of the invention to provide evidence of tampering to packaging associated with confectionery, such as an inner die fold and sleeve type packaging.

None of the above described prior art describes a tamper evident die fold or tamper evident die-fold-and-sleeve packaging concept

SUMMARY OF THE INVENTION

In one aspect, the invention is a tamper evident wrapper having a pattern of folds defining regions and capable of being folded along the folds to enclose a product. At least two of the regions are overlapping and attached to each other at a lap seal region when the wrapper is folded along the folds. At least one of the overlapping regions has a breakaway region such that upon opening the wrapper to access the product, the breakaway region tears away to provide evidence of tampering. Preferably, the breakaway region is defined by perforations (which may be die cut, or formed by some other method).

The inner wrapper may be included in a tamper evident die fold and sleeve primary package for a chocolate bar by taking an inner die fold wrapper substantially as described above and die folding it around the outer surface of a chocolate bar. The chocolate bar and wrapper are then enclosed in a substantially tubular, lap sealed outer sleeve.

DETAILED DESCRIPTION OF THE PREFERRED EMBODIMENT

An important object of the present invention is to provide a tamper evident die fold wrapper in a die fold and sleeve packaging format. A "die fold" or "die fold wrapper" as used herein, is simply a wrapper which is folded around a product in a mechanical wrapping operation in which a die is used to form the folds in the wrapper, such as by pushing the article and wrapper through the die. A "die-fold-and-sleeve" combination is a well known format in the packaging art comprising a die fold inner wrapper which is usually not sealed and made out of foil or paper laminated foil, and an essentially tubular lap sealed outer wrapper usually made of paper. This packaging format is closely associated in the consumer consciousness with chocolate products in bar form, and provides certain advantages. The outer sleeve bears informational and attractive printing and can be removed from the product by sliding without damaging the inner wrapper. In some cases, the product can be slid back into the outer sleeve. The inner wrapper, which is typically foil or other wrapper material having dead fold properties which permit it to conform to the shape of the piece inside, serves as a "plate" for the product once opened. The inner die fold and outer sleeve are typically folded together and sealed in the same packaging operation. The inner and outer wrapper can be "interlaced," such that an inner portion of the outer wrapper is within the lap seal region of the inner wrapper and sealed with an adhesive.

As used herein, unless expressly stated otherwise, "inside" and "inner" means closer to the wrapped product and "outer" means toward an exterior surface of the packaging.

A "lap seal" is a seal in which an outside surface of one edge of a wrapper is sealed to the inside edge of an opposing overlapping edge of the wrapper, such that the resulting seal area is flat. This configuration is distinguished from a "fin seal," in which an inside surface of one edge of the wrapper is sealed to an inside of another edge of the wrapper, leaving a "fin." In the preferred embodiments herein, both the inner die fold and outer sleeve are lap sealed.

In a popular prior art die fold and sleeve packaging format, the inner die fold is not sealed but is merely wrapped shut. This type of package is relatively easily tampered with by sliding the outer sleeve off the inner die fold and unwrapping the inner die fold. The package can then be re-wrapped without leaving evidence of tampering. One method of making the inner die fold tamper evident would be to seal along the length of the overlapping edges of the die fold. In this case, the package provides evidence of tampering because the inner die fold is torn upon opening. However, tearing the entire inner die fold wrapper detracts from the overall aesthetic appeal of the packaging format, and destroys the "plate" functionality of the inner die fold wrapper.

Figure 3:
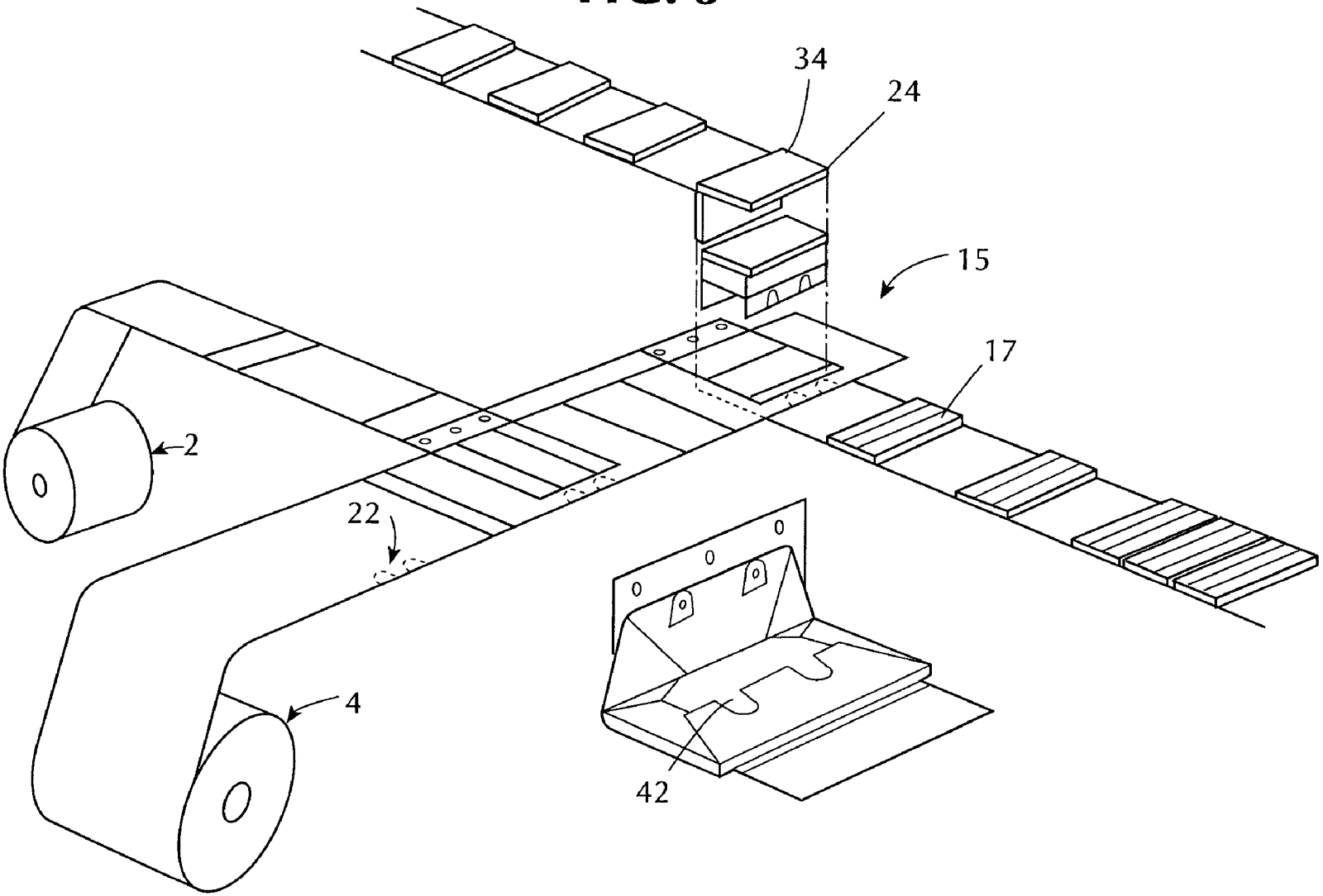
FIG. 3 depicts a die fold operation in which an inner die fold wrapper according to the invention and outer sleeve are aligned and folded around a bar product from roll stock.

The invention will be described in connection with preferred embodiments depicted in the Figures. An inner die fold wrapper (6) may be cut from roll stock wrapper material (4). Alternatively, the wrapper (6) could be provided in the form of an individual sheet. In a preferred embodiment, the wrapper (6) is cut from a preprinted roll stock of wrapper material, and the advancement of the roll stock through the cutting apparatus is controlled using print eyes (10, 12) printed on the roll stock, or by mechanical advancement. The sheet is cut at cut off lines (18, 20), which in preferred embodiments form the short sides of the inner die fold wrapper. In a preferred embodiment, the sides of the wrapper parallel to the machine direction are the sides which are ultimately lap sealed. To some extent, the designation of wrapper sides is arbitrary and dependent on the machinery used. Likewise, length and width of the inner die fold are not particularly limited, provided the wrapper can be die folded. Although the embodiment of FIG. 3 shows roll fed stock, other systems of advancing and folding the wrappers may be used, including without limitation, sheet fed systems.

Inner wrapper material is preferred to have dead fold properties such that the wrapper folds securely around the object without adhesive. A "dead fold" means a fold which remains in position without sealing. Suitable inner wrapper materials include, without limitation, certain plastics, plastic laminated papers, coated papers, foils, and paper foil laminates. The preferred wrapper materials are soft temper foils or paper foil laminates having a thickness of about 10 to about 20 microns.

Figure 1:
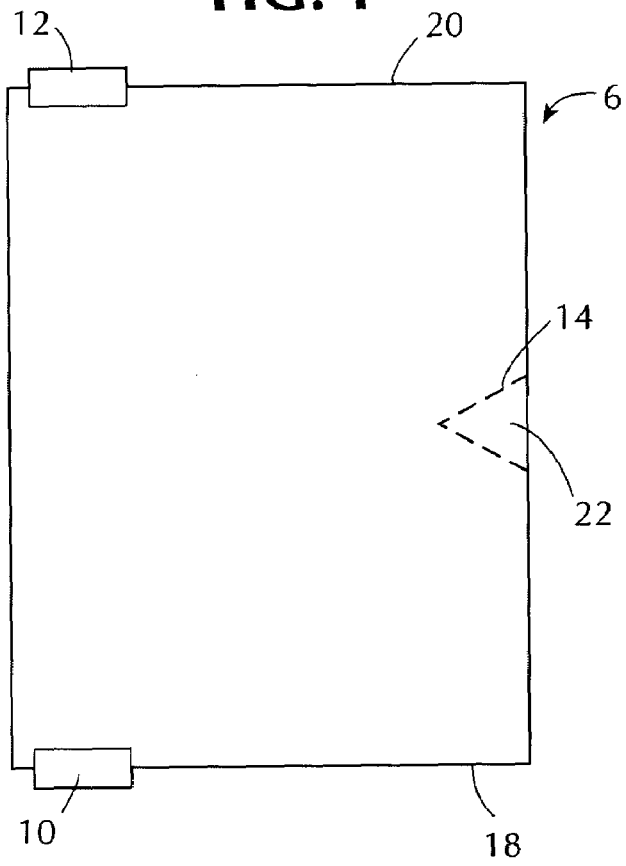
FIG. 1 depicts a die fold wrapper according to the invention which has not been folded.

The inner wrapper material roll stock advances in a machine direction perpendicular to the cut off lines (18, 20). In registration with the advancement of the roll stock, perforations (14) are die cut on a side of the wrapper forming breakaway regions (22). The edge of the wrapper with the breakaway region is ultimately lap sealed to the opposing edge in the final product configuration. As shown in FIG. 1, an edge of the wrapper forms one side of the breakaway region.

Preferably the die cut perforations (14) are in the form of a closed shape, such as a triangle as shown in FIG. 1 or other polygon. While one side of the wrapper material may form one side of the closed shape, as shown in FIG. 1, in other embodiments, an oval, circle, or other closed shape is offset from the edge of the wrapper. A plurality of breakaway regions (also referred to herein as "breakaway portions") may be formed on the edge of the wrapper, or offset from the edge, as described.

Perforation cutting can be by any means known in the art, such as by platen die, rotary die, or a laser cutter. In the presently preferred embodiments, an interchangeable platen die is used.

Figure 2:
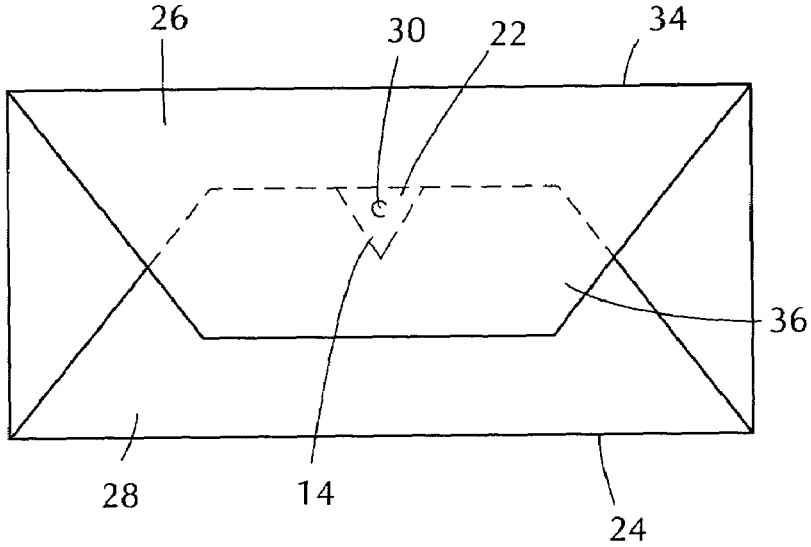
FIG. 2 depicts a die fold wrapper which has been folded, showing overlapping regions of the packaging attached to each other, and a triangular breakaway region in one of the overlapping regions.

FIG. 2 depicts the inner die fold wrapper (6) folded around a product at fold lines (34) and (24). Fold lines (34) and (24) define regions (26) and (28), a portion of which overlap in a lap seal region (36). The lap seal region (36) is shown defined by broken lines bordering part of region (28) and solid lines bordering part of region (26). The entire lap seal region (36) defined by the overlapping portions is not sealed, but only a portion of it, defined by one or more breakaway regions (22). The nature of the wrapped product is not critical, but the packaging is advantageously used in packaging confectionery; and in particular in a die-fold-and-sleeve packaging for a chocolate bar. A bead of adhesive (30) is applied to the breakaway region (22) and attaches the breakaway region to the overlapping edge of the inner wrapper. If an attempt is made to unfold the wrapper, the torn break away portion (42) will provide evidence of tampering as shown in FIG. 3. FIG. 3 shows breakaway region (22) located on region (28) on the inner side of the lap seal. The breakaway region could also be located on an outer side of the lap seal, such as on region (26).

Hot melt adhesives, which are solid or semisolid at room temperature and flow at elevated temperatures, are widely used in the packaging arts and are particularly preferred in connection with attaching the die cut breakaway region to the overlapping wrapper edge. Cold resin adhesives, which are liquid at room temperature when applied, are also widely used in the packaging industry and might be used in some circumstances. Cold resin adhesives are less preferred as they tend to cure more slowly and are generally used where greater adhesive strength is required. Cold resin adhesive typically requires residence time in a compression device to cure, which renders this type of adhesive less preferred for most applications.

The breakaway region (22) preferably breaks away cleanly along the perforations (14). This requires balancing the adhesive strength of the bond formed between the overlapping edges of the wrapper and the pull out strength of the perforations bounding the breakaway region. One or a plurality of breakaway regions may be employed. It is within the scope of the invention to employ a relatively long bead of adhesive along the length of the lap seal, provided that a breakaway region is defined by perforations. However, the use of an elongated seam in this manner is a less preferred embodiment because the resulting broken away structure is believed to provide a less attractive "plate" for the product.

The inner or outer surface of the inner wrapper and/or outer wrapper may bear printed indicia. The aesthetic appeal of the breakaway region may be enhanced by printing on the inside surface of the inner wrapper. In this manner a communication feature such as a logo or some other interesting design or promotion (e.g. a brand name, advertisement, or contest information) may appear on the breakaway region adhered to the opposite edge of the wrapper after it is torn off from the first edge. It has not generally been the practice in the art to print on an inner die fold sleeve, and of course printing on the breakaway regions as described herein is not known in the art, as the breakaway regions themselves are novel.

FIG. 3 depicts a preferred embodiment in which a roll stock of inner die fold material (4), having die cut breakaway regions (22) is fed in a direction perpendicular to the feeding direction of a roll stock of outer sleeve material (2). At a wrapping station (15), product such as chocolates in bar form (17) are aligned with the inner wrapper and outer sleeve. The wrappers are folded around the bar along fold lines (24, 34) and sealed in substantially the same operation.

The foregoing description of the preferred embodiments is for purposes of illustration only and is not to be considered limiting of the invention, which is defined by the following claims.

We claim:

1. A tamper evident primary package folded around a confectionery product comprising:

an inner die fold foil or paper laminated foil wrapper having a pattern of folds defining regions and capable of being dead folded along the folds to conform to the outer surface of the confectionery product, wherein two of said regions form first and second overlapping regions in a lap seal region and are attached to each other when the wrapper is folded along the folds, and the first overlapping region has at least one breakaway portion defined by perforations adhesively attached to the second overlapping region such that upon opening the inner die fold wrapper to access the product, the breakaway portion is at least partially torn away from said first overlapping region, and a substantially tubular lap sealed outer sleeve over said inner die fold wrapper and said confectionery product forming a die fold and sleeve primary package.

2. The tamper evident package of claim 1, wherein said confectionery product is a chocolate bar.

3. The tamper evident package of claim 1, wherein said outer sleeve is paper.

4. The tamper evident package of claim 1, wherein the inner die fold wrapper comprises a plurality of breakaway portions formed at an edge of the die fold wrapper in a closed shape defined by perforations and the edge of the die fold wrapper.

5. The tamper evident package of claim 4, wherein said closed shape is a regular polygon.

6. The tamper evident package of claim 1, wherein the inner die fold wrapper comprises a breakaway portion, one side of said breakaway portion is formed by an edge of the die fold wrapper, and perforations define the breakaway portion.

7. The tamper evident package of claim 1, wherein the breakaway portion is in the form of an oval, circle or regular polygon offset from an edge of the wrapper and defined by die cut perforations.

8. The tamper evident package of claim 1, wherein said breakaway portion is attached to said second overlapping region with a bead of adhesive applied to the breakaway portion.

9. The tamper evident package of claim 1, wherein said adhesive is a hot melt adhesive.

10. A tamper evident die fold wrapper having a pattern of folds defining regions and folded along the folds to enclose a product, at least two of said regions overlapping and attached to each other at a lap seal region when the wrapper is folded along the folds, at least one of said overlapping regions having a breakaway region, whereby, upon opening the wrapper to access the product, said breakaway region tears away to provide evidence of tampering, and wherein said breakaway region bears printing indicia on an inner surface thereof.

11. A tamper evident primary package folded around a confectionery product comprising:

an inner die fold wrapper having a pattern of folds defining regions and capable of being dead folded along the folds to conform to the outer surface of the confectionery product, wherein two of said regions form first and second overlapping regions in a lap seal region and are attached to each other when the wrapper is folded along the folds, and the first overlapping region has at least one breakaway portion defined by perforations adhesively attached to the second overlapping region such that upon opening the inner die fold wrapper to access the product, the breakaway portion is at least partially torn away from said first overlapping region, and a substantially tubular lap sealed outer sleeve over said inner die fold wrapper and said confectionery product to form a die fold and sleeve primary package, wherein said inner die fold wrapper is paper laminated foil, and the breakaway portion bears printing on an inner paper surface of the paper laminated foil, and the outer sleeve bears printing on the outer surface thereof.

* * * * *